United States Patent [19]

Aurich et al.

[11] 3,993,234

[45] Nov. 23, 1976

[54] REEL FOR FEEDING CLOTH IN ROPE FORM

[75] Inventors: Christoph W. Aurich, Clemson, S.C.; James Keith Turner, Lincolnton; William Cleere Sturkey, Charlotte, both of N.C.

[73] Assignee: Gaston County Dyeing Machine Company, Mount Holly, N.C.

[22] Filed: Jan. 21, 1976

[21] Appl. No.: 651,129

[52] U.S. Cl. ..... 226/193; 242/155 R; 29/121.1; 144/246 C

[51] Int. Cl.[2] ..... B65H 27/00

[58] Field of Search ..... 226/182, 184, 190, 193, 226/195; 242/153, 155 R; 29/121 R, 121 A, 124; 144/246 R, 246 C, 242 C

[56] References Cited

UNITED STATES PATENTS

| | | | |
|---|---|---|---|
| 3,774,829 | 11/1973 | Francia et al. | 226/195 X |
| 3,833,162 | 9/1974 | Sato | 226/193 X |
| 3,907,189 | 9/1975 | Griffith | 226/182 X |

*Primary Examiner*—Robert W. Saifer
*Attorney, Agent, or Firm*—Richards, Shefte & Pinckney

[57] ABSTRACT

A reel for feeding cloth in rope form is provided that employs a plurality of spaced vanes radially arranged in alternately inclined relation so that their projected profiles cross intermediate their length and the outer vane edges are formed with a gently undulating configuration beyond such crossing for particularly effective feeding action.

5 Claims, 4 Drawing Figures

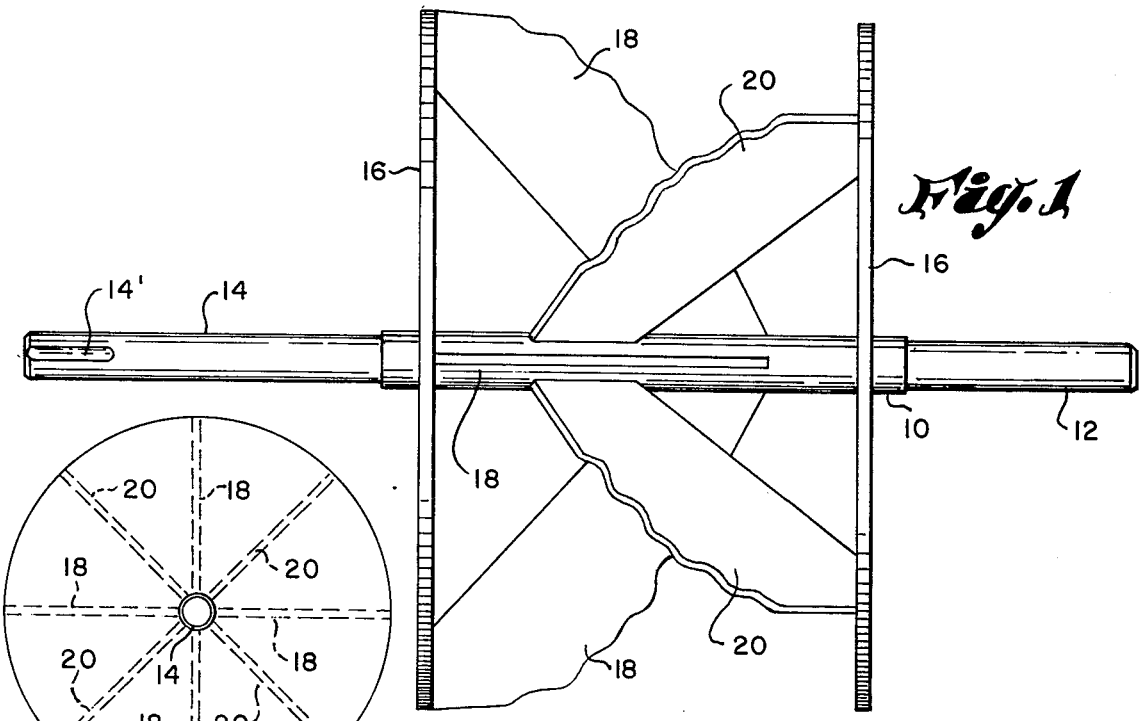
Fig. 1
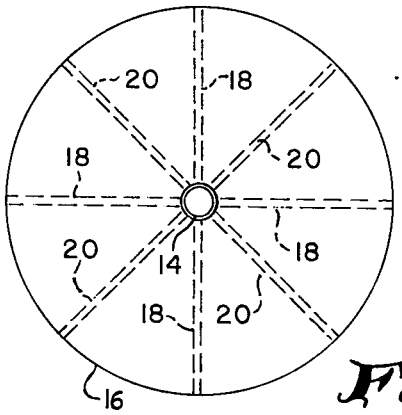
Fig. 2
| X | Y | RAD | |
|---|---|---|---|
| 1-11/32 | 1/2 | 7/16 | A |
| 2-11/32 | 29/32 | 1/2 | B |
| 3-1/4 | 1-1/2 | 3/8 | C |
| 3-13/16 | 2-3/8 | 1/2 | D |
| 4-3/8 | 3-9/16 | 5/8 | E |
| 2-1/32 | 1/16 | 3/8 | F |
| 3-1/4 | 11/16 | 7/16 | G |
| 4 | 1-17/32 | 3/8 | H |
| 4-13/16 | 2-1/2 | 1/2 | I |
| 5-5/8 | 3-11/16 | 5/8 | J |
Fig. 4
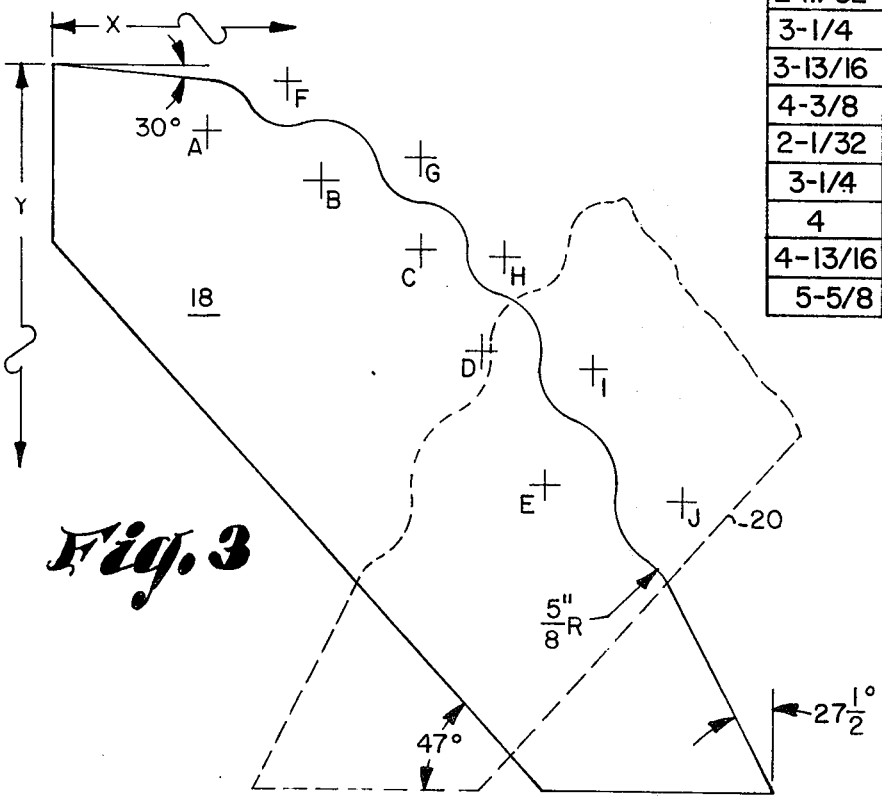
Fig. 3

REEL FOR FEEDING CLOTH IN ROPE FORM

BACKGROUND OF THE INVENTION

Where cloth must be fed in rope form for processing as, for example, in systems such as the one disclosed in U.S. Pat. No. 3,780,544, difficulty is commonly encountered in maintaining adequate traction to avoid slippage at roll or reel members included in the system for feeding purposes.

The present invention provides a reel structure that is specially arranged to eliminate such slippage dependably during feeding, while avoiding any adverse effect on the cloth rope as the feeding takes place.

SUMMARY OF THE INVENTION

According to the present invention, the reel structure provided includes a plurality of spaced vanes that are disposed radially with respect to the reel axis in alternately inclined relation so that their projected profiles cross intermediate the wave length and consequently form a V-like channel through which the cloth rope is fed as the reel is rotated, while the outer edges of the vanes are shaped with a gently undulating configuration in each direction beyond the projected profile crossing to produce in combination with the V-like channel form the previously noted feeding action free of slippage and free of adverse effect on the cloth rope being fed.

DESCRIPTION OF THE DRAWINGS

FIG. 1 is a side elevation of a reel structure embodying the present invention;

FIG. 2 is a left end elevation of the FIG. 1 embodiment, slightly reduced in scale;

FIG. 3 is a detail of one of the reel vanes, indicating the projected profile crossing in broken lines; and FIG. 4 is a tabulation specifying a preferred form of out vane edge configuration.

DETAILED DESCRIPTION OF THE INVENTION

The representative reel structure embodiment of the present invention shown in FIG. 1 comprises a central shaft 10 forming the axis of the reel and having journal portions 12 and 14 for mounting the reel for rotation, with one of these journal portions 14 being sufficiently longer to include a keyway at 14' so as to receive a driving connection thereat through which the reel may be rotated.

On the reel axis shaft 10, spaced circular heads 16 are carried transversely in fixed relation, and between these spaced heads 16 a plurality of alternately inclined vanes 18 and 20 are mounted in spaced planes radiating from the reel axis shaft 10. These vanes 18 and 20 are segment-shaped with the ends thereof truncated at proper angles so that one end thereof may be fixed at the inside face of one of the reel heads 16, while the other vane end extends short of the opposite reel head and is fixed at the reel axis shaft 10. The vanes 18 and 20 should be regularly spaced circularly between the reel heads 16, and at least three vanes should be spaced within 90° of the reel circumference (see FIG. 2).

Due to the alternately inclined arrangement of the vanes 18 and 20 their projected profiles cross intermediate their length, as indicated in FIG. 3, so that as noted earlier they form a V-like channel through which a cloth rope may be trained to travel for feeding as the reel is rotated. In addition, while the inner edges of vanes 18 and 20 are straight, the outwardly directed edges are formed with a gently undulate lengthwise configuration that extends substantially in both directions beyond the point of projected vane profile crossing which has the effect of preventing slippage of a cloth rope being fed by the reel.

FIG. 3 diagrams a vane 18 that has been found to operate with excellent effectiveness in a 13½ inch diameter reel mounted on a shaft 10 having a diameter of one inch between its heads 16, and FIG. 4 specifies the radii locations for the outer vane edge undulations where the full X dimension is 6½ inches and the full Y dimension is 6¼ inches, with the vane end attached to the adjacent head 16 being 1½ inches wide and the other end attached to the shaft 10 being 2-1/16 inches wide.

The function of the undulate outer vane edges is to increase remarkably the tractive hold of the crossing vanes 18 and 20 on a cloth rope trained through the V-like channel they form. If processing conditions are such as to require a greater than normal pulling force on the cloth rope being fed, the effect is simply to cause the rope to move downwardly along the outer vane edges and be gripped more forcefully by the crossing vanes 18 and 20 to supply the greater pulling force required, while whenever the pulling force required lightens the cloth rope tends to climb upwardly along the vane edges due to the centrifugal force resulting from the reel rotation and the natural tendency of the cloth rope to spread as the required pulling force lightens. As a result, the cloth rope being fed by the disclosed reel structure reacts naturally at the outer vane edges to shift for whatever level of tractive gripping is needed to maintain the feeding without slippage, while at the same time avoiding any undue adverse handling of the cloth rope by the vanes 18 and 20.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. A reel for feeding cloth in rope form comprising a plurality of spaced vanes mounted in planes aligned with the reel axis and alternately inclined oppositely in relation to said axis with the projected profiles of said vanes crossing intermediate of their length and with the outwardly directed edges of said vanes having a gently undulate lengthwise configuration extending substantially in both directions beyond the point of projected vane profile crossing.

2. A reel for feeding cloth in rope form as defined in claim 1 wherein said vanes are regularly spaced in planes radiating from said reel axis.

3. A reel for feeding cloth in rope form as defined in claim 2 wherein said vanes are mounted between spaced heads carried transversely at the reel axis and extend alternately from one of said heads short of the other one to a fixed position at the reel axis.

4. A reel for feeding cloth in rope form as defined in claim 2 wherein at least three of said vanes are spaced within 90° of the circumference of said reel.

5. A reel for feeding cloth in rope form as defined in claim 1 wherein said reel axis is formed by a shaft having journal portions for mounting said reel for rotation and additionally having a portion for receiving a driving connection through which said reel may be rotated.

* * * * *